United States Patent [19]

Potel et al.

[11] Patent Number: 4,638,742

[45] Date of Patent: Jan. 27, 1987

[54] VERTICALLY ADJUSTABLE EMERGENCY SUPPORT OF A CAR BODY

[75] Inventors: Gerd Potel; Karl-Heinz Buchholz, both of Nuremberg, Fed. Rep. of Germany

[73] Assignee: MAN Maschinenfabrik Augsburg-Nürnberg Aktiengesellschaft, Nuremberg, Fed. Rep. of Germany

[21] Appl. No.: 698,932

[22] Filed: Feb. 7, 1985

[30] Foreign Application Priority Data

Feb. 8, 1984 [DE] Fed. Rep. of Germany ..... 3404377

[51] Int. Cl.[4] ..... B61F 5/16

[52] U.S. Cl. ..... 105/199.3; 105/199.4

[58] Field of Search ..... 105/199 C, 199 R, 199 CB; 280/113, 114, 115, 125, 130, 131, 432, 433, 438 R, 439, 440, 461 R, 515

[56] References Cited

U.S. PATENT DOCUMENTS

| | | | |
|---|---|---|---|
| 3,832,954 | 9/1974 | Amwake | 105/199 C |
| 4,213,400 | 7/1980 | Synder et al. | 105/199 C |
| 4,245,564 | 1/1981 | Eulenfeld | 105/199 C |
| 4,353,310 | 10/1982 | Jantzen | 105/199 C |
| 4,353,311 | 10/1982 | Jantzen | 105/199 C |

FOREIGN PATENT DOCUMENTS

| | | | |
|---|---|---|---|
| 8137758 | 5/1982 | Fed. Rep. of Germany . | |
| 779134 | 11/1980 | U.S.S.R. | 105/199 CB |

*Primary Examiner*—Robert B. Reeves
*Assistant Examiner*—David F. Hubbuch
*Attorney, Agent, or Firm*—Becker & Becker, Inc.

[57] ABSTRACT

A vertically adjustable emergency support for the bodies of, for example, rail vehicles. Due to wear of the wheel tires, the bogie frame and the car body supported on it tend to descend. In the case of emergency supports in the region of the center pivot, where access is difficult, it is proposed, in order to compensate for this drop, to connect the striker plate which faces an emergency spring at a distance "w" to a box underneath which as vertically guided via guide elements on sliding-contact liners of a cut-out in the bogie frame. If the distance "w" increases due to wear of the wheel tires, an adjustment has to be made by raising the box via a plate connected to the center pivot. Plates of a thickness which compensates for the wear are inserted between the box and abutments which are connected to the bogie frame. After securing the plates via bolts, the car body is lowered again, whereupon the distance "w" is restored. In another embodiment for fixing the box relative to the bogie frame, after the box has been moved upwards far enough to restore the clearance "w", it is fixed in its position by a saw tooth connection including saw teeth engaging in a positive connection produced between the box and the bogie frame.

5 Claims, 4 Drawing Figures

VERTICALLY ADJUSTABLE EMERGENCY SUPPORT OF A CAR BODY

BACKGROUND OF THE INVENTION

1. Field of the Invention

The present invention relates to a vertically adjustable emergency support of a car body, e.g. a railway car body, where an emergency spring is mounted on the underside of a car body so as to be concentric relative to a center pivot, and a clearance "w" is provided between said emergency spring and a striker plate.

2. Description of the Prior Art

Emergency supports are conventionally provided in railway bogies having air spring bags on each side. For the purpose of the emergency support, a cylindrical composite rubber-bonded-metal spring connected to the bogie side sill is arranged coaxially to the air bag at its underside. If an air bag fails, the car body comes to rest on said cylindrical spring, which acts as an emergency support. In order to enhance reliability against derailment, the rubber-bonded metal springs combined with the air bags are relied upon for emergency support only on one bogie of a car, whereas the other bogie has an emergency spring arranged concentrically about its center pivot, on which spring the car body will come to rest before the rubber-bonded metal springs of the air bags of this bogie come into operation. This results in a three-point support of the car body, whereby the bogie which has the centrally arranged emergency spring is capable of performing turning motions about its longitudinal axis where the track is twisted and, as a result, can follow irregularities of the track position free of any constraint. A disadvantage of the central emergency spring is in the fact that it is difficult to adjust the height of the emergency support. Whereas a vertical adjustment of the emergency supports integrated in the air bags is effected in a simple manner by packings placed between the bogie side sills and the rubber-bonded metal springs, this is not so easily possible in the case of the central emergency support because of the inaccessibility of the spring, and because of the center pivot (Gebrauchsmuster 81 37 758).

SUMMARY OF THE INVENTION

The emergency support of the present invention is characterized primarily in that the underside of the striker plate is connected to a box, sid box being provided with guide elements on the end faces of its side plates; the guide elements are movably guided, in a vertical direction, on sliding-contact liners of a rectangular cut-out in a bogie frame; the emergency support is further characterized in that the box is capable of being fixed to the bogie frame at a distance "w" between the emergency spring and the striker plate, and in that the box is provided on its inner sides with buffers and rubber buffers which surround the center pivot with a clearance in the longitudinal and transverse direction.

Due to the striker plate being freely movable in a vertical direction, it is easy, even in the difficult-to-reach area around the center pivot, to vary the distance between the emergency spring and the striker plate. By opening the leveling valves of the air bags associated with the bogie, it is possible to inflate the latter. A retainer connected to the center pivot enables the box to be raised and fixed in this raised position. After restoring the air bags to their normal position, the lowering of the bogie frame caused by tire wear is again compensated for.

Pursuant to one advantageous further development of the present invention, a bottom plate of the box is supported on abutments which are rigidly connected to the bogie frame through the intermediary of plates; the plates and the box can be connected to the abutments by means of screws or bolts.

An object of the present invention therefore is to enable changes caused by wheel tire wear in the clearance between the centrally situated emergency support and a striker plate of the bogie frame located therebelow to be compensated for in a simple manner.

BRIEF DESCRIPTION OF THE DRAWINGS

This object, and other objects and advantages of the present invention, will appear more clearly from the following specification in conjunction with the accompanying drawings, in which.

DESCRIPTION OF PREFERRED EMBODIMENTS

Figure 1:
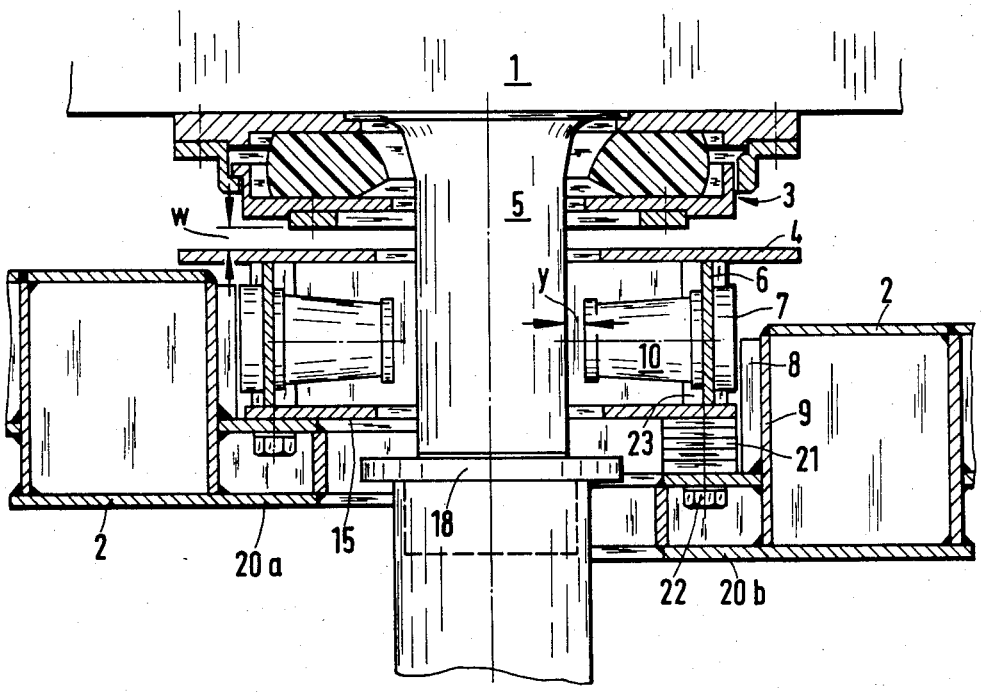
FIG. 1 is a cross-section in the region of the center pivot with one inventive embodiment of the vertically adjustable emergency support, and plates serving as spacers.

Referring now to the drawings in detail, to provide emergency support of a car body 1 where air bags or some other form of pneumatic cushioning is used for the secondary suspension, an emergency spring 3 is provided as shown in FIG. 1 between the car body 1 and a bogie frame 2, said emergency spring 3 being disposed in such a way that a clearance "w" exists between the car body 1 and a striker plate 4. In this arrangement, the emergency spring 3 concentrically surrounds a kingpin or center pivot 5. Although the air bags, which are not shown, are provided with emergency supports similar to those of the air bags of a second bogie, the clearances of these air bags are greater than the clearance "w", so that the emergency spring 3 will come into operation before the car body 1 comes to bear on the emergency supports of the air bags. The objective of the central emergency support is to maintain the ability of the bogie to turn about its longitudinal center-line relative to the car body 1 in the event the air bags fail. However, the preset clearance "w" is unfortunately not maintained, but tends to increase in consequence of the wear of the rims or wheel tires. As a result, in the event the air bags fail, the car body 1 can drop to such an extent that parts of the equipment disposed below the car body 1 touch the ground and are destroyed.

In order to maintain this clearance "w" constant, provision is made for the striker plate 4 to be adjusted.

To this end, the striker plate 4 is connected underneath to a box 6, the ends of which are provided with guide elements 7 which are freely movable in the vertical direction on sliding-contact liners 8. The liners 8 are arranged on the inner sides of a rectangular cut-out 9 in the bogie frame 2. To control the lateral motions of the car body 1, the center pivot 5 is surrounded, with a clearance "y", by rubber buffers 10 which form an integral unit with the box 6.

If the clearance "w" between the emergency spring 3 and the striker plate 4 is to be adjusted, for instance due to wear of the wheel tires, the leveling valves of the lateral air bags, which are not shown, are actuated, so that the car body 1 along with the emergency spring 3 is raised. A plate 18 connected to the center pivot 5 lifts the box 6, via a bottom plate 15 and an interposed spacer, by an amount required to insert plates 21 between the bottom plate 15 and an abutment 20*a*, 20*b* which is rigidly connected to the bogie frame 2; the total thickness of the plates 21 inserted being chosen such that the clearance "w" between the emergency spring 3 and the striker plate 4 is restored to the original value before wear of the tread occurred (see the right-hand half of FIG. 1). The plates 21 are fixed by means of screws 22 which pass through the abutments 20*a*, 20*b* as well as the plates 21, and screw into threads 23 which are connected to the corners of the box 6.

Figure 2:
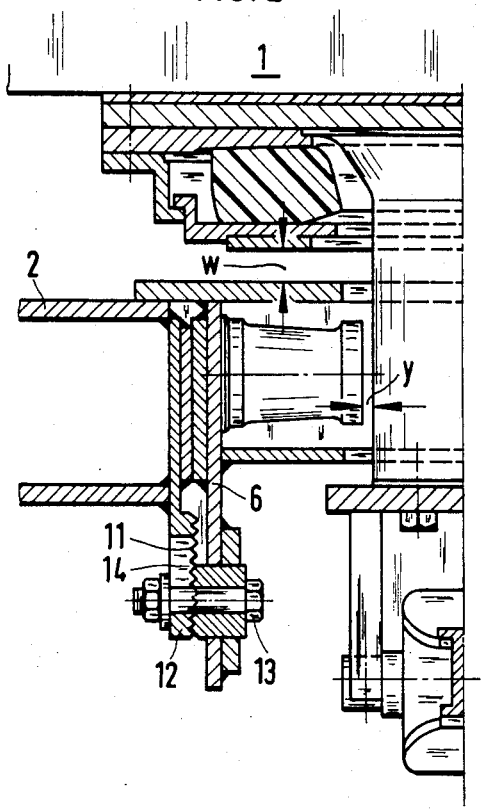
FIG. 2 is a cross-section in the region of the center pivot with another inventive embodiment of the vertically adjustable emergency support, and a saw-tooth connection for the purpose of fixing the box.

An alternative solution for fixing the box 6 relative to the bogie frame 2 is shown in FIG. 2. After the box 6 has been moved upwards far enough to restore the clearance "w", it is fixed in its position by a saw-tooth connection 11. For this purpose, the side plates of the box 6 are extended downwards. The bogie frame 2 is also provided with downwardly directed brackets 12, each having a slot 14 in which a bolt 13 can slide. After adjusting the clearance "w", the bolt 13 is tightened up, so that the saw teeth of the connection 11 engage and a positive connection is produced between the box 6 and the bogie frame 2.

Figure 3:
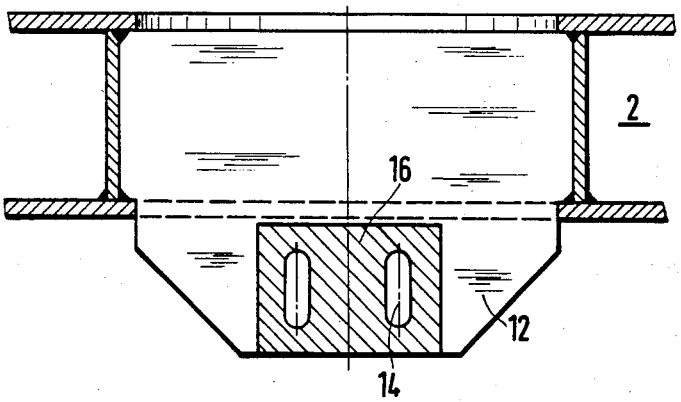
FIG. 3 shows the saw-tooth connection of FIG. 2, for fixing a box of the emergency support, after the adjustment.

FIG. 3 shows a cut-out of FIG. 2 with the bracket 12, which is connected to the bogie frame 2 and has the slots 14 in which are guided the bolts 13 (FIG. 2). In the area of the slots 14, the bracket 12 is provided with a saw-tooth profile or serration 16.

Figure 4:
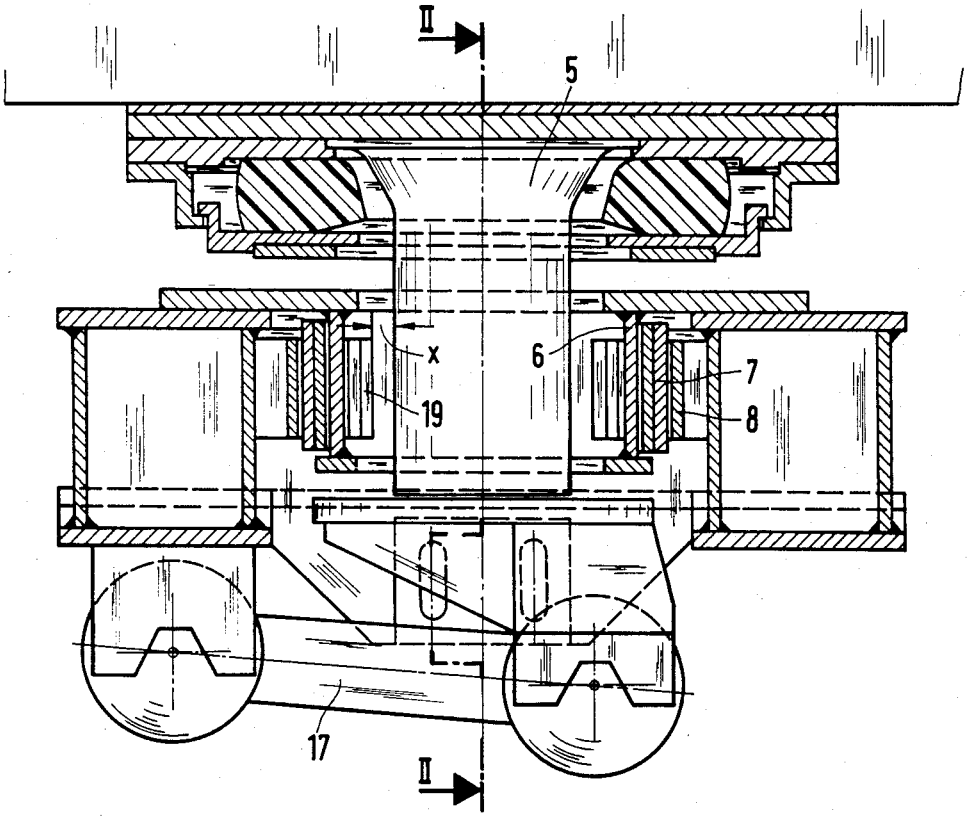
FIG. 4 is a longitudinal section through one inventive embodiment of the emergency support.

A longitudinal section is shown in FIG. 4. The box 6 is again provided at its ends with guide elements 7 which are guided by sliding-contact liners 8. The center pivot 5 is surrounded in the longitudinal direction by buffers 19, with a clearance "x", so that the buffers 19 limit the motion of the center pivot 5 in order to prevent overloading of the link 17, which is supported in rubber bushings. The clearance "x" is selected such that the center pivot 5 will contact the buffer 19 before the loading of the link 17 rises to a level where permanent deformation of the latter is caused or before the center pivot 5 suffers damage due to the relatively long leverage between the articulation of the link and the car body.

The present invention is, of course, in no way restricted to the specific disclosure of the specification and drawings, but also encompasses any modifications within the scope of the appended claims.

What we claim is:

1. A vertically adjustable emergency support for a car body having an emergency spring mounted on an underside of the car body in such a way as to be concentric relative to a center pivot; a striker plate disposed around said center pivot and provided at a distance "w" from said emergency spring; said emergency support comprising:

a box, which is disposed around said center pivot and is connected to that side of said striker plate remote from said emergency spring; said box having side plates disposed at right angles to said striker plate;

guide elements provided on those sides of said side plates remote from said center pivot;

first buffers and second rubber buffers provided on those sides of said side plates facing said center pivot, said first buffers and second rubber buffers, surrounding said center pivot with clearance in the longitudinal and transverse directions of said car body respectively;

a bogie frame likewise disposed around said center pivot, and having a rectangular cutout which is open toward said striker plate;

sliding-contact liners, on which said guide elements are movably guided in a vertical direction as provided therewith; and means for adjustable fixing said box to said bogie frame in such a way that said distance "w" further exists between said emergency spring and said striker plate even when encountering bearing surface wear.

2. A vertically adjustable emergency support according to claim 1, in which said means for adjustably fixing said box to said bogie frame includes: a bottom plate connected at right angles to said side plates of said box and disposed around said center pivot, with said first and second buffers being disposed between said striker plate and said bottom plate; abutments rigidly connected to said bogie frame; plates which are adapted to be disposed, if needed, between said bottom plate and said abutments to establish said distance "w" between said emergency spring and said striker plate; screw connections for interconnecting said bottom plate, said plates, and said abutments.

3. A vertically adjustable emergency support according to claim 1, in which said means for adjustably fixing said box to said bogie frame includes: brackets connected to said bogie frame; and respective vertically movable saw-tooth connections for connecting those side plates of said box which are parallel to the longitudinal direction of said car body to respective ones of said brackets.

4. A vertically adjustable emergency support according to claim 1, in which said first buffers are spaced at a distance "x" from said center pivot in the longitudinal direction of said car body.

5. A vertically adjustable emergency support according to claim 1, in which said second rubber buffers are spaced at a distance "y" from said center pivot in the transverse direction of said car body.

* * * * *